US007891050B2

(12) United States Patent
Liddell

(10) Patent No.: US 7,891,050 B2
(45) Date of Patent: Feb. 22, 2011

(54) HANDLE ASSEMBLY FOR A CLEANING APPLIANCE

(75) Inventor: Sarah Helen Liddell, Gloucestershire (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 444 days.

(21) Appl. No.: 11/631,109

(22) PCT Filed: Jul. 1, 2005

(86) PCT No.: PCT/GB2005/002604

§ 371 (c)(1),
(2), (4) Date: Dec. 28, 2006

(87) PCT Pub. No.: WO2006/008443

PCT Pub. Date: Jan. 26, 2006

(65) Prior Publication Data

US 2008/0250602 A1 Oct. 16, 2008

(30) Foreign Application Priority Data

Jul. 22, 2004 (GB) ..... 0416359.8

(51) Int. Cl.
*A47L 9/00* (2006.01)

(52) U.S. Cl. ..... 15/410; 15/335; 220/833; 220/834; 220/835

(58) Field of Classification Search ..... 15/335, 15/410; 220/833, 834, 835; *A47L 9/00*
See application file for complete search history.

(56) References Cited

U.S. PATENT DOCUMENTS 1,977,302 A * 10/1934 Brill ..... 220/833
2,867,833 A 1/1959 Duff
4,571,772 A 2/1986 Dyson
4,846,042 A 7/1989 Wetty
6,039,062 A * 3/2000 Karakaedos ..... 135/16
6,526,623 B1 * 3/2003 Dyson ..... 15/334
7,017,222 B2 * 3/2006 Dunn ..... 15/106

(Continued)

FOREIGN PATENT DOCUMENTS

CN 2347538 Y 11/1999

(Continued)

OTHER PUBLICATIONS

Chinese office action mailed Nov. 28, 2008 directed to corresponding application No. 200580024290.2; 5 pages.

(Continued)

*Primary Examiner*—David A Redding
(74) *Attorney, Agent, or Firm*—Morrison & Foerster LLP

(57) ABSTRACT

A handle assembly for a cleaning appliance includes a handle portion and a tubular wand having an open end configured to receive tools or other accessories when the cleaning appliance is in use. The handle assembly also includes a wand cap which is movable between a first position in which the wand cap covers the open end of the tubular wand and a second position in which the open end of the tubular wand is not covered by the wand cap. The wand cap is releasably connected to the handle portion or the tubular wand in a snap-fit manner. This provides an advantageous construction which reduces the risk of damage and the cost of repair.

12 Claims, 4 Drawing Sheets

U.S. PATENT DOCUMENTS

2004/0134017 A1 7/2004 Kess

FOREIGN PATENT DOCUMENTS

| | | |
|---|---|---|
| EP | 0037674 | 8/1985 |
| JP | 2002-508200 | 3/2002 |
| JP | 2004-166889 | 6/2004 |
| WO | WO99/30605 | 6/1999 |
| WO | WO-99/30605 | 6/1999 |
| WO | WO 01/71087 A1 | 9/2001 |
| WO | WO 2005/079648 A1 | 9/2005 |

OTHER PUBLICATIONS

Japanese Office Action mailed on May 7, 2009 directed at counterpart application No. 2007- 522003; 2 pages.

* cited by examiner

HANDLE ASSEMBLY FOR A CLEANING APPLIANCE

REFERENCE TO RELATED APPLICATIONS

This application is a national stage application under 35 USC 371 of International Application No. PCT/GB2005/002604, filed Jul. 1, 2005, which claims the priority of United Kingdom Application No. 0416359.8, filed Jul. 22, 2004, the contents of both of which prior applications are incorporated herein by reference.

FIELD OF THE INVENTION

The invention relates to a handle assembly for a cleaning appliance, particularly but not exclusively to a handle assembly for a vacuum cleaner of the upright type.

BACKGROUND OF THE INVENTION

The general construction and method of operation of upright vacuum cleaners are both well known. Also well known is the capability of upright vacuum cleaners to be converted from a traditional upright cleaning mode (in which the entire vacuum cleaner is manoeuvred across a floor surface) into a cylinder mode for "above-the-floor" cleaning. For such purposes, upright cleaners often incorporate an integral hose and wand arrangement which can be brought into operation when required. In some cases, the hose and wand assembly consists of an integral hose which forms part of the airflow path between the cleaner head and the separation apparatus when the machine is used in upright mode, with one end of the hose being releasable from a socket in the main body when above-the-floor cleaning is to be carried out. A separate wand, which is often carried on the main body of the vacuum cleaner, can then be attached to the hose for improving the reach of the hose and wand assembly. A disadvantage of this type of arrangement is that, when the machine is used in upright mode, the incoming air still has to travel through the hose which unnecessarily increases losses.

Another known type of hose and wand assembly is that used on the Dyson range of upright vacuum cleaners, model numbers DC01, DC03, DC04 and DC07. In these vacuum cleaners, the lower end of the hose is fixedly connected to the main body of the respective cleaner but the upper end is slidingly connected to the tubular portion of a wand handle. The wand handle comprises a moulded handle portion with a tubular wand rigidly connected thereto. The handle portion can be attached to the main body of the vacuum cleaner and used in the manner of a handle, in which case the upper end of the hose is slid to the upper end of the wand so that the wand is then stored inside the hose. When above-the-floor cleaning is required, the handle portion is released from the main body, the upper end of the hose is slid to the lower end of the wand and tools can be attached to the handle portion to effect the cleaning required. A valve arrangement automatically selects the point of entry of the dirty air into the vacuum cleaner: in upright mode the point of entry is via the cleaner head and for above-the-floor cleaning the point of entry is via the hose and wand. The principle by which this entire arrangement operates is described in EP 0037674B.

When a wand handle is deliberately designed to act as a handle in one mode of use and as a wand to which tools are to be attached in another mode of use, it is convenient to ensure that large items of debris cannot fall or be sucked into the wand at the wrong time. To this end, the Dyson DC03, DC04 and DC07 vacuum cleaners currently on the market have moveable wand caps which are designed to cover the otherwise open end of the tubular wand when the vacuum cleaner is being used for upright cleaning. In each case, the wand cap is moveable to a position in which accessories and tools can be attached directly to the end of the tubular wand for above-the-floor cleaning. The wand cap used on the Dyson DC03 vacuum cleaner is described in WO99/30605. In other cases, the wand cap used on the relevant vacuum cleaner has included apertures to allow air to be sucked into the wand handle whilst preventing large items of debris from entering the tubular wand. In some cases, the wand cap has proved to be vulnerable to damage and/or complicated or expensive to manufacture or repair.

SUMMARY OF THE INVENTION

Other preferable and advantageous features of the invention are set out in the detailed description below.

The invention provides a handle assembly for a cleaning appliance comprising a handle portion and a tubular wand, the tubular wand having an open end adapted to receive tools or other accessories when the cleaning appliance is in use, the handle assembly further comprising a wand cap which is movable between a first position in which the wand cap covers the open end of the tubular wand and a second position in which the open end of the tubular wand is not covered by the wand cap, characterised in that the wand cap is releasably connected to the handle portion or the tubular wand in a snap-fit manner.

The handle assembly according the invention has the advantage of being effective but also simple and cheap to manufacture. Furthermore, it has the advantage that, should excessive force be applied to the wand cap, the wand cap is liable to become detached from the remainder of the handle assembly before it breaks. It can therefore be easily and quickly re-attached to the handle assembly without the use of specialist tools or replacement parts which is beneficial for the user.

In a preferred arrangement, retaining means are provided for retaining the wand cap in either the first position or the second position. Preferably, the retaining means comprise at least one profiled channel and a corresponding projection arranged to travel along the channel as the wand cap moves between the first and second positions. This arrangement is particularly effective and simple to achieve.

Other preferable and advantageous features of the invention are set out in the subsidiary claims.

BRIEF DESCRIPTION OF THE DRAWINGS

An embodiment of the invention will now be described with reference to the accompanying drawings in which.

DETAILED DESCRIPTION OF THE INVENTION

Figure 1:
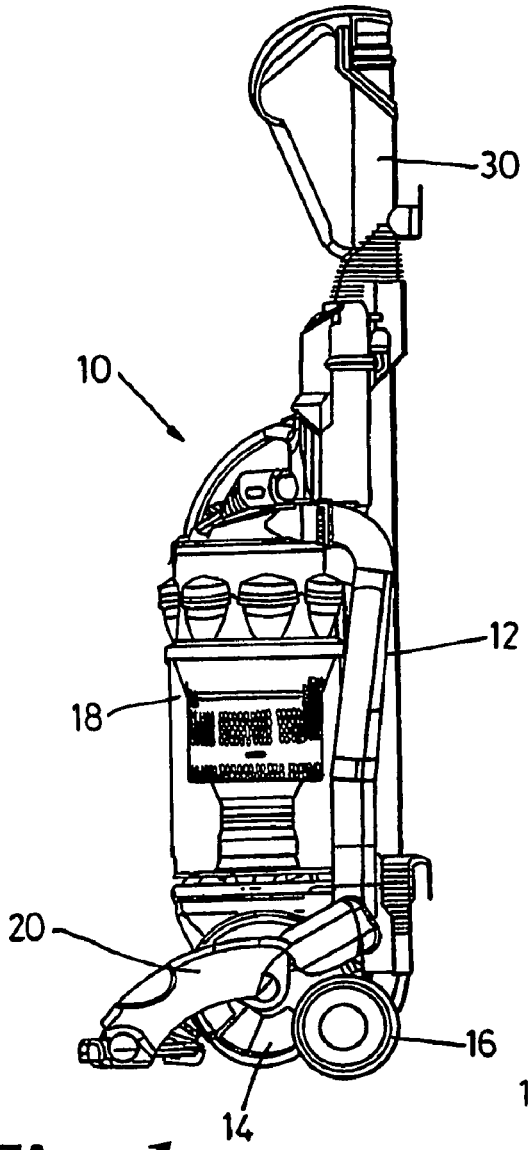
FIG. 1 is a side view of a vacuum cleaner incorporating a handle assembly according to the invention.

A vacuum cleaner incorporating a handle assembly according to the invention is shown in FIG. 1. The upright vacuum cleaner 10 shown in FIG. 1 has a main body 12 which includes a motor casing 14, supporting wheels 16 and dirt- and dust-separating apparatus 18. The vacuum cleaner 10 also has a cleaner head 20 and a handle assembly 30. In the embodiment shown, the dirt- and dust-separating apparatus 18 comprises a cyclonic arrangement but this could readily be replaced by a filter, a bag or a combination of different known separation devices. The nature of the dirt- and dust-separating apparatus 18 is not material to the present invention.

It will be understood that, in normal upright use, the vacuum cleaner 10 is manoeuvred over a surface to be cleaned (a floor surface) whilst the motor causes dirty air to be sucked into the cleaner 10 via the cleaner head 20. The dirty air is passed to the dirt- and dust-separating apparatus 18 where the dirt and dust is extracted and clean air is expelled to the atmosphere.

Figure 2:
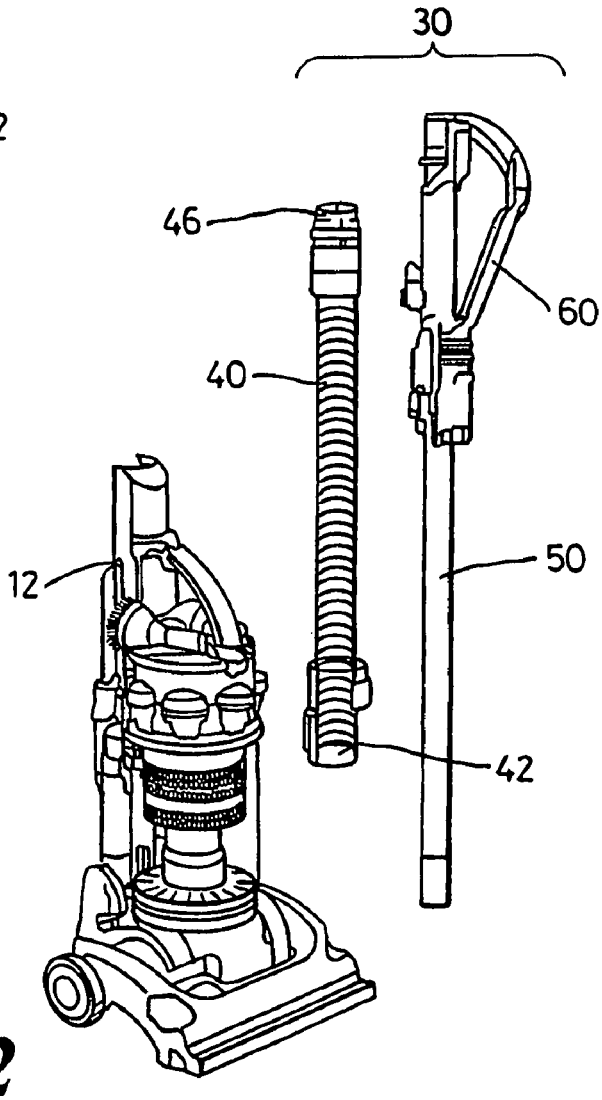
FIG. 2 is a perspective view of the vacuum cleaner of FIG. 1 showing the hose and the wand handle removed from the main body.

FIG. 2 shows the vacuum cleaner 10 with the handle assembly 30 separated from the main body 12. The handle assembly 30 comprises a hose 40 having a first end 42 and a second end 46, a tubular wand 50 and a handle portion 60. The first end 42 of the hose 40 is normally connected to the main body 12 behind the motor casing 14. The upper end 46 of the hose 40 is connected to the handle portion 60. Both of these connections are preferably releasable connections to facilitate maintenance and repair. The tubular wand 50 is slidably mounted in the handle portion 60 as will be described in more detail below.

Figure 3:
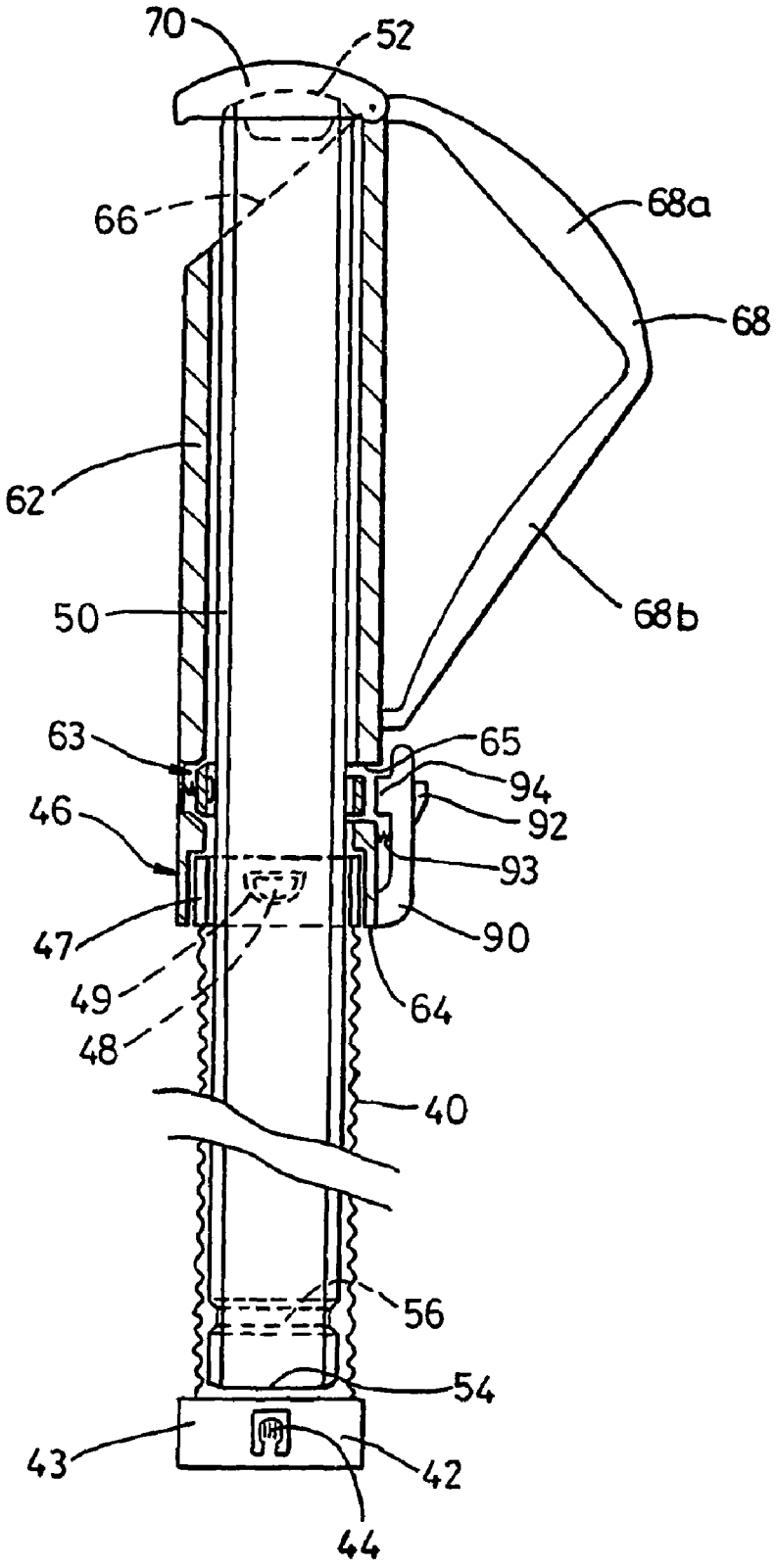
FIG. 3 is a schematic sectional view through the handle assembly forming part of the vacuum cleaner shown in FIGS. 1 and 2 and showing the handle assembly with the wand cap in the first position.

FIG. 3 shows the handle assembly 30 in detail, although not to scale. The hose 40 is a sprung hose and is ideally (but not essentially) of sufficient length to enable a full flight of stairs to be cleaned with the vacuum cleaner main body 12 remaining at the foot of the stairs. The first end 42 of the hose 40 has a collar 43 overmoulded or otherwise securely fixed thereto with at least one resilient catch 44 incorporated therein. The resilient catch 44 co-operates with a recess (not shown) in a socket on the main body 12 in which the first end 42 of the hose 40 is received. The catch 44 and recess together form a releasable connection between the first end of the hose 40 and the main body 12. This type of connection is well known and similar types of releasable connection would be equally suitable for use in this application.

The second end 46 of the hose 40 has a similar releasable connection formed by a resilient catch 48 moulded into a collar 47 which is overmoulded or otherwise securely fastened to the second end 46 of the hose 40. However, in the case of the second end 46 of the hose 40, the resilient catch 48 is arranged to be received in a recess or aperture 49 moulded into the lower end of the handle portion 60. Again, the type of connection formed by the catch 48 and the recess 49 is well known and could be replaced by another type of connector having similar functionality.

The handle portion 60 will now be described in detail. The handle portion 60 essentially comprises a tubular part 62 having open ends 64, 66. The lower end 64 of the tubular part 62 includes the recess or recesses 49 which receive the resilient catch or catches 48 at the second end 46 of the hose 40. The internal diameter of the tubular part 62 is dimensioned so that the tubular wand 50 is able to slide within the tubular part 62. A gripping handle 68 is integrally moulded or is otherwise fixedly attached to a side wall of the tubular part 62 and extends laterally therefrom. Ideally, the gripping handle 68 has a first gripping area 68*a* which is designed for use when the vacuum cleaner 10 is being used for upright cleaning and a second gripping area 68*b* which is designed for use when the vacuum cleaner 10 is being used for above-the-floor cleaning.

A wand cap 70 is pivotably mounted on the tubular part 62 at the upper end 66 thereof. The wand cap 70 is moveable between a generally horizontal closed position and a generally vertical open position. The wand cap 70 has a generally circular shape when viewed from above and has a number of bleed holes arranged in its upper surface through which air is able to pass if required, as will be described in more detail below. In the position shown in FIG. 3, the wand cap 70 covers the upper end of the tubular wand 50, although the bleed holes allow air to be drawn into the tubular wand 50 whilst simultaneously preventing large objects from being drawn into the vacuum cleaner 10.

The tubular wand 50 is arranged inside the tubular part 62 of the handle portion 60. The tubular wand 50 has rounded upper and lower ends 52, 54. The diameter of the tubular wand 50 is such that it will fit with clearance inside the interior of the tubular part 62 and also inside the hose 40. The tubular wand 50 has a groove 56 formed in its outer surface near the lower end 54 thereof. This groove 56 co-operates with a catch mechanism 63 forming part of the handle portion 60 and which is designed to retain the tubular wand 50 in a predetermined position but the catch mechanism 63 does not form part of the present invention. The upper end 52 of the tubular wand 50 is dimensioned so that it is able to receive floor tools and accessory tools (not shown) which are intended to be used with the vacuum cleaner 10 during above-the-floor cleaning. The length of the tubular wand 50 is such that, when the wand cap 70 is in its horizontal position and the hose is in its relaxed (shortest) state, the tubular wand 50 extends between the wand cap 70 and the collar 43 at the first end of the hose 40.

A handle release catch 90 is pivotably mounted on the tubular part 62 of the handle portion 60 as shown in FIG. 3. The handle release catch 90 carries a catch 92 which co-operates with a recess on the main body 12 of the vacuum cleaner 10 so as to secure the handle assembly 60 onto the main body 12 for storage and for upright cleaning. A spring 93 urges the handle release catch 90 away from the tubular part 62 and stop means (not shown) limit the movement of the handle release catch 90 in that direction. Such arrangements are well known. However, in the present embodiment of the invention, an actuator 94 is provided on the rear surface of the handle release catch 90.

The actuator 94 takes the form of a projection which projects from the rear surface of the handle release catch 90 towards the tubular part 62 of the handle assembly 30. An opening 65 formed in the tubular part 62 of the handle portion 60 allows the actuator 94 to pass through the tubular part 62 and to operate the catch mechanism 63 when the handle release catch is pressed against the action of the spring 93. It will thus be appreciated that the catch mechanism 63 is operated by the same action as that required to operate the handle release catch 90 to release the handle assembly 30 from the main body 12 of the vacuum cleaner 10.

Figure 5A:
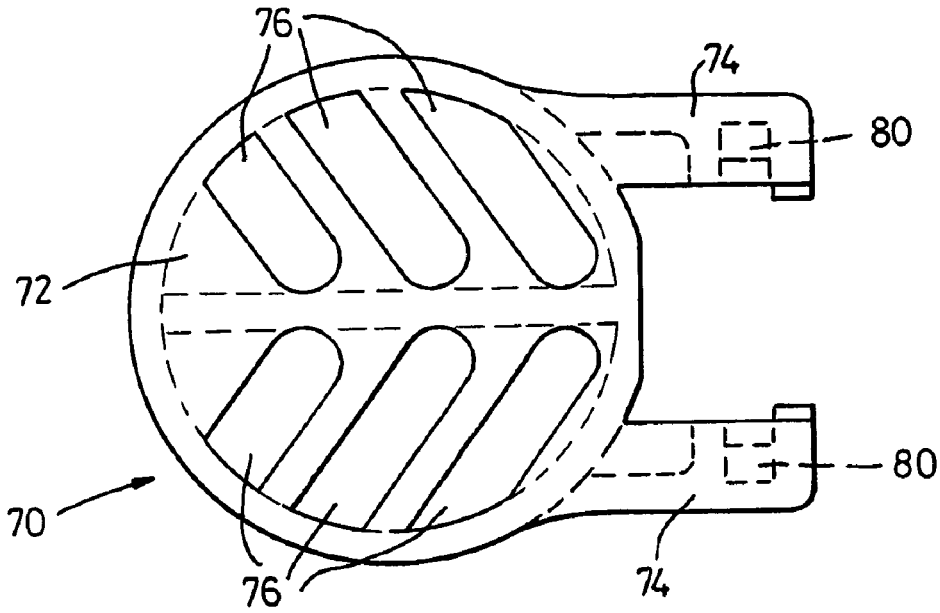
FIGS. 5(*a*) and 5(*b*) are top and side views respectively of the wand cap forming part of the wand handle of FIGS. 3 and 4.
Figure 5B:
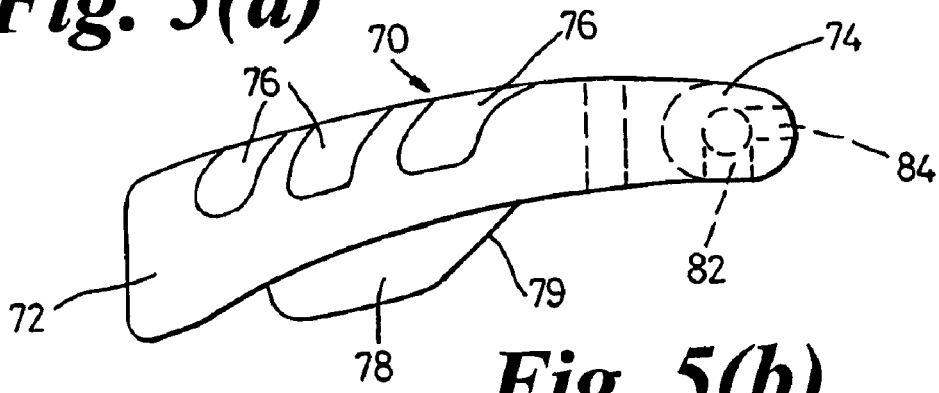

The wand cap 70 is shown in detail (and on an enlarged scale) in FIGS. 5(*a*) and 5(*b*). The wand cap 70 has a generally circular central portion 72 and two rearwardly extending lugs 74. The central portion 72 has six apertures 76 arranged therein so that, when the wand cap 70 is in the position shown in FIG. 3, air can pass through the apertures 76 and into the tubular wand 50 in the event that suction is applied to the tubular wand 50. The part of the central portion 72 between the apertures 76 prevents large items of debris which happen to be near the end of the tubular wand 50 from entering the vacuum cleaner. A depending rib or fin 78 is located on the underside of the central portion 72, that is the side of the central portion 72 facing the tubular wand 50 when the wand cap 70 is in the position shown in FIG. 3. The rib or fin 78 has a contact surface 79 on the side thereof facing the lugs 74. The purpose of the rib or fin 78 and the contact surface 79 will be described below.

Figure 6A:
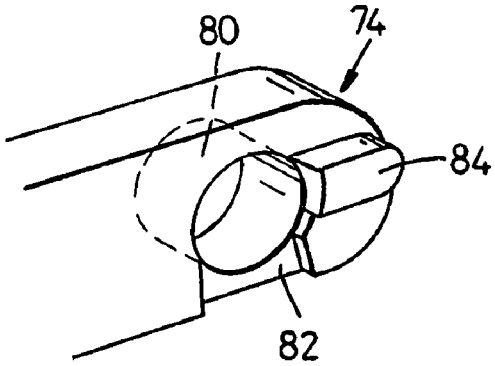
FIGS. 6(*a*) and 6(*b*) illustrate the retaining means forming part of the handle assembly of FIGS. 3 and 4.
Figure 6B:
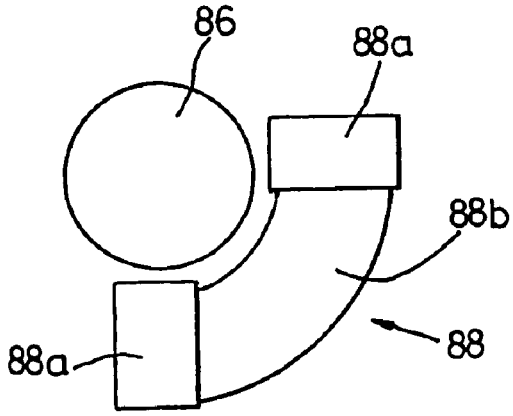

The lugs 74 are spaced apart from one another as shown in FIG. 5(*a*). Each lug 74 is the mirror image of the other lug 74. Each lug 74 has a circular socket 80 formed therein on the side facing the other lug 74. A lead-in face 82 is formed between the socket 80 and the lower edge of the respective lug 74 and a projection 84 is formed in the side wall of the lug 74 next to the socket 80. The projection 84 preferably has a part-cylindrical surface. The detail of the lug 74 is shown in FIG. 6(*a*).

The wand cap 70 is manufactured from a plastics material as a single piece moulding. The resilience of the plastics material allows the lugs 84 to flex slightly away from one another when an appropriate force is applied.

The wand cap 70 is mounted on the upper end of the tubular part 62 by the engagement of two opposed pivot pins 86 formed on the upper end 66 of the tubular part 62 in the sockets 80. A profiled channel 88 is formed in the upper end of the tubular part 62 next to the pivot pins 86 as shown in FIG. 6(*b*). The channel 88 has recessed end portions 88*a* which are dimensioned so as to receive the projection 84. The channel 88 also has a central portion 88*b* which follows an arcuate path and whose depth is less than that of the end portions 88*a*. The arrangement is such that, as the pivot pins 86 rotate within the sockets 80, each projection 84 moves along the respective channel 88. When the wand cap 70 is in one of the positions shown in FIGS. 3 and 4, the projection 84 is seated in an end portion 88*a* of the channel 88 and is retained there. If the wand cap 70 is to be moved from one of the illustrated positions to the other, sufficient force must be applied to the wand cap 70 to flex the lugs 74 outwardly in order to allow the projection 84 to travel along the central portion 88*b* to the other end portion 88*a*. The projection 84 will then drop into the other end portion 88*a* and be retained therein until sufficient force is applied to the wand cap 70 to release the projection 84 therefrom.

FIG. 3 illustrates the relative positions of all of the components of the handle assembly 30 when the handle assembly 30 is stored on the main body 12 of the vacuum cleaner 10 or is being used for upright cleaning. The collar 43 is connected to the socket (not shown) on the main body 12 and the catch 92 on the handle release catch 90 is engaged with the relevant recess on the main body 12 to secure the handle assembly 30 on the main body 12. In this position, the tubular wand 50 is in its first position extending away from the handle portion 60 inside the hose 40. The hose 40 is in its relaxed state and so is as short as possible in this configuration. The lower end 54 of the tubular wand 50 reaches substantially to the first end 42 of the hose 40. The tubular wand 50 is prevented from sliding out of the hose 40 by the fact that the collar 43 has an internal diameter which is slightly smaller than the outer diameter of the tubular wand 50.

The upper end 52 of the tubular wand 50 extends through the tubular part 62 of the handle portion 60 as far as the upper end 66. The wand cap 70 is in its horizontal position as shown so that the otherwise open upper end 52 of the tubular wand 50 is covered to prevent debris being sucked into the tubular wand 50. As has already been mentioned, air can be sucked into the tubular wand 50 through the apertures 76.

Figure 4:
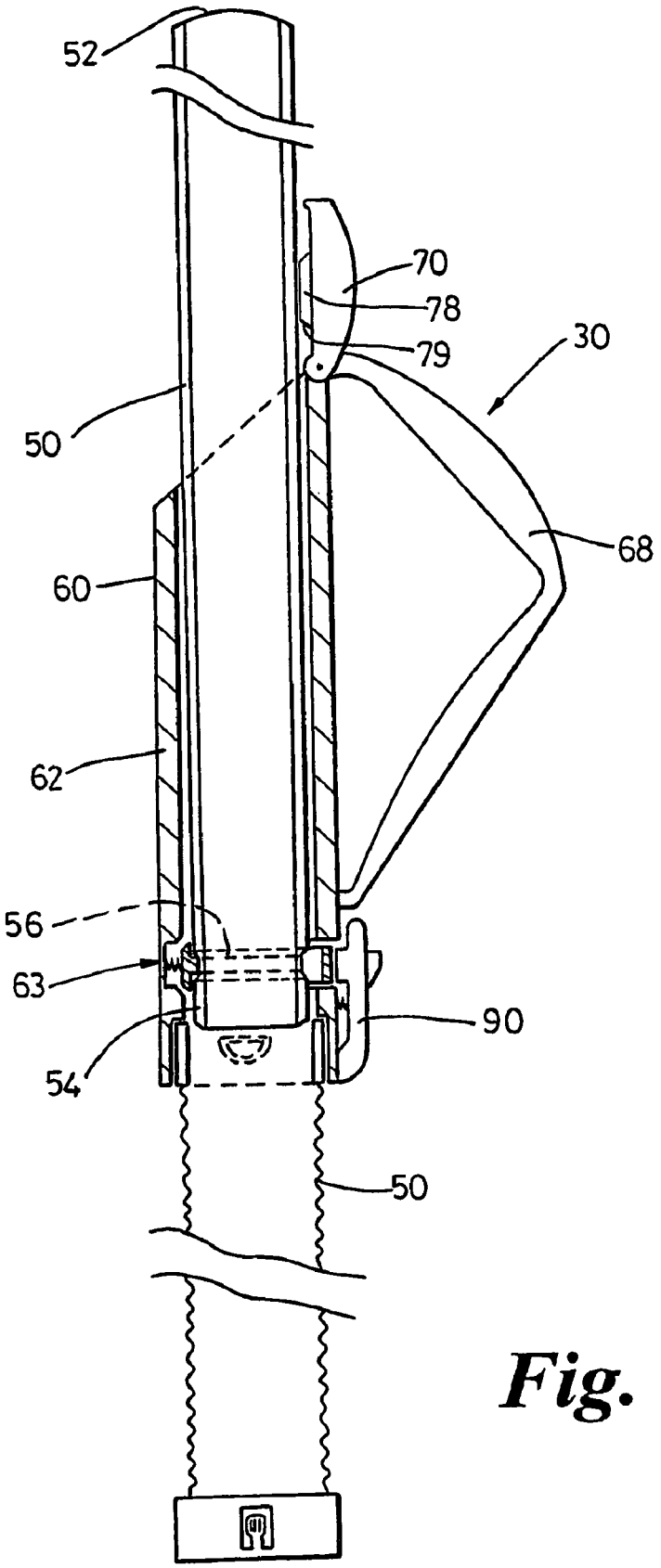
FIG. 4 is a view similar to FIG. 3 but with the wand cap shown in the second position.

FIG. 4 illustrates the second configuration of the handle assembly 30 with the tubular wand 50 in its second position. In this position, the tubular wand 50 has been slidingly moved upwards relative to the handle portion 60 until the catch mechanism 63 locks the tubular wand 50 relative to the handle portion 60. Because the lower end 54 of the tubular wand 50 is now located within the handle portion 60, the hose 40 is free to flex and move in order to facilitate above-the-floor cleaning.

As the tubular wand 50 is moved from the position shown in FIG. 3 to the position shown in FIG. 4, the wand cap 70 is automatically pivoted from the generally horizontal position shown in FIG. 3 to the generally vertical position shown in FIG. 4. This is achieved simply by the movement of the tubular wand 50 with respect to the handle portion 60. As the upper end 52 of the tubular wand 50 is moved towards the wand cap 70, the upper end 52 comes into contact with the contact surface 79 of the rib or fin 78 on the underside of the wand cap 70. The inclined shape of the contact surface 79 causes the wand cap 70 to rotate clockwise as the tubular wand 50 is moved upwardly, thus automatically moving out of the path of the tubular wand 50. The shapings described above then cause the wand cap 70 to be held in the generally vertical position whilst the tubular wand 50 remains in its second position.

In this configuration, the handle assembly 30 is highly suitable for above-the-floor cleaning. When it is desired to return the handle assembly 30 to the first configuration, the user is able simply to depress the handle release catch 90 towards the handle portion 60 against the action of the spring 93. The actuator 94 releases the tubular wand 50 which is thus able to slide within the handle portion 60 back to the first position as shown in FIG. 3. The hose 40 is again stored around the tubular wand 50 and the handle assembly 30 can be re-attached to the main body 12 of the vacuum cleaner 10. The wand cap 70 is pressed into its generally horizontal position by the user.

It will be appreciated that the invention is not intended to be limited to the specific details of the embodiment described. Different arrangements and modifications will be apparent to a skilled reader. For example, the configuration of the gripping areas could be very different in design, as could the catches.

The invention claimed is:

1. A handle assembly for a powered cleaning appliance, comprising:

a handle portion;

a tubular wand having an open end configured to receive tools or other accessories when the cleaning appliance is in use; and a wand cap configured to move between a first position in which the wand cap covers the open end of the tubular wand and a second position in which the open end of the tubular wand is not covered by the wand cap, the wand cap being detachably connected to one of the handle portion and the tubular wand in a snap-fit manner in both the first position and the second position, wherein by being detachably connected, the wand cap is configured to detach from the one of the handle portion and the tubular wand such that it is not in the first position or the second position, wherein the wand cap consists of a central portion and two resilient lugs extending away therefrom, and wherein each lug incorporates a socket for receiving a corresponding pin.

2. A handle assembly as claimed in claim 1, wherein the wand cap is detachably connected to the handle portion or the tubular wand by at least one pin and at least one corresponding socket.

3. A handle assembly as claimed in claim 2, further comprising a retainer for retaining the wand cap in either the first position or the second position.

4. A handle assembly as claimed in claim 1, further comprising a retainer for retaining the wand cap in either the first position or the second position.

5. A handle assembly as claimed in claim 1, wherein the wand cap carries a depending portion which, when the wand cap is in the first position, extends into the open end of the tubular wand.

6. A vacuum cleaner incorporating a handle assembly according to claim 1.

7. A handle assembly as claimed in claim 1, wherein when the tools or other accessories are in a state of being received on the open end of the tubular wand, the tools or other accessories are usable with the cleaning appliance during cleaning.

8. A handle assembly for a powered cleaning appliance, comprising:

a handle portion;

a tubular wand having an open end configured to receive tools or other accessories when the cleaning appliance is in use;

a wand cap configured to move between a first position in which the wand cap covers the open end of the tubular wand and a second position in which the open end of the tubular wand is not covered by the wand cap, the wand cap being detachably connected to one of the handle portion and the tubular wand in a snap-fit manner in both the first position and the second position; and a retainer for retaining the wand cap in either the first position or the second position, wherein by being detachably connected, the wand cap is configured to detach from the one of the handle portion and the tubular wand such that it is not in the first position or the second position, and wherein the retainer comprises at least one profiled channel and a corresponding projection configured to travel along the channel as the wand cap moves between the first and second positions.

9. A handle assembly as claimed in claim 8, wherein the at least one projection is located on the wand cap.

10. A handle assembly as claimed in claim 8, wherein the wand cap is detachably connected to the handle portion or the tubular wand by at least one pin and at least one corresponding socket.

11. A handle assembly for a powered cleaning appliance, comprising:

a handle portion;

a tubular wand having an open end configured to receive tools or other accessories when the cleaning appliance is in use; and a wand cap configured to move between a first position in which the wand cap covers the open end of the tubular wand and a second position in which the open end of the tubular wand is not covered by the wand cap, the wand cap being detachably connected to one of the handle portion and the tubular wand in a snap-fit manner in both the first position and the second position, wherein by being detachably connected, the wand cap is configured to detach from the one of the handle portion and the tubular wand such that it is not in the first position or the second position, and wherein a plurality of apertures are provided in the wand cap so that, when the wand cap is in the first position, air is able to be drawn into the tubular wand via the apertures.

12. A handle assembly for a powered cleaning appliance, comprising:

a handle portion;

a tubular wand having an open end configured to receive tools or other accessories when the cleaning appliance is in use; and a wand cap configured to move between a first position in which the wand cap covers the open end of the tubular wand and a second position in which the open end of the tubular wand is not covered by the wand cap, the wand cap being detachably connected to one of the handle portion and the tubular wand in a snap-fit manner in both the first position and the second position, wherein by being detachably connected, the wand cap is configured to detach from the one of the handle portion and the tubular wand such that it is not in the first position or the second position, wherein the wand cap is detachably connected to the handle portion or the tubular wand by at least one pin and at least one corresponding socket, and wherein the wand cap includes lugs each incorporating a socket for receiving a corresponding pin.

* * * * *